US008526271B2

(12) United States Patent
Huang

(10) Patent No.: US 8,526,271 B2
(45) Date of Patent: Sep. 3, 2013

(54) CAPACITIVE MICROMACHINED ULTRASONIC TRANSDUCER WITH VOLTAGE FEEDBACK

(75) Inventor: Yongli Huang, San Jose, CA (US)

(73) Assignee: Kolo Technologies, Inc., San Jose, CA (US)

( * ) Notice: Subject to any disclaimer, the term of this patent is extended or adjusted under 35 U.S.C. 154(b) by 596 days.

(21) Appl. No.: 12/745,742

(22) PCT Filed: Dec. 3, 2008

(86) PCT No.: PCT/US2008/085434

§ 371 (c)(1), (2), (4) Date: Jun. 2, 2010

(87) PCT Pub. No.: WO2009/073743

PCT Pub. Date: Jun. 11, 2009

(65) Prior Publication Data

US 2010/0244623 A1 Sep. 30, 2010

Related U.S. Application Data

(60) Provisional application No. 60/992,027, filed on Dec. 3, 2007.

(51) Int. Cl.
*G10K 9/12* (2006.01)
*H04R 19/00* (2006.01)

(52) U.S. Cl.
USPC ..... 367/181

(58) Field of Classification Search
USPC ..... 367/181
See application file for complete search history.

(56) References Cited

U.S. PATENT DOCUMENTS

| | | | | |
|---|---|---|---|---|
| 2004/0267134 | A1 | 12/2004 | Hossack et al. | |
| 2006/0004290 | A1 | 1/2006 | Smith et al. | |
| 2006/0273805 | A1 | 12/2006 | Peng et al. | |
| 2007/0016026 | A1 | 1/2007 | Thomenius et al. | |
| 2010/0244623 | A1 * | 9/2010 | Huang | 310/300 |

FOREIGN PATENT DOCUMENTS

| | | |
|---|---|---|
| JP | 62149299 | 7/1987 |
| JP | 10186021 | 7/1998 |
| JP | 2006020313 | 1/2006 |
| WO | WO 2009073743 A1 * | 6/2009 |

OTHER PUBLICATIONS

Translated of the Chinese Office Action mailed Jul. 13, 2012 for Chinese patent application No. 200880117484.0, a counterpart foreign application of U.S. Appl. No. 12/745,742, 9 pages.
Translated the Chinese Office Action mailed Jan. 14, 2013 for Chinese patent application No. 200880117484.0, a counterpart foreign application of U.S. Appl. No. 12/745,742, 8 pages.
Translated the Japanese Office Action mailed Dec. 7, 2012 for Japanese patent application No. 2010-536238, a counterpart foreign application of U.S. Appl. No. 12/745,742, 4 pages.

* cited by examiner

*Primary Examiner* — Daniel Pihulic
(74) *Attorney, Agent, or Firm* — Lee & Hayes, PLLC

(57) ABSTRACT

Implementations of a capacitive micromachined ultra-sonic transducer (CMUT) include a feedback component connected in series with the CMUT. The feedback component applies a feedback on a voltage applied on the CMUT for affecting the voltage applied on the CMUT as a capacitance of the CMUT changes during actuation of the CMUT.

20 Claims, 14 Drawing Sheets

CAPACITIVE MICROMACHINED ULTRASONIC TRANSDUCER WITH VOLTAGE FEEDBACK

CROSS-REFERENCE TO RELATED APPLICATION

This application claims the benefit of U.S. Provisional Patent Application No. 60/992,027, filed Dec. 3, 2007, the entire disclosure of which is incorporated herein by reference.

BACKGROUND

Capacitive micromachined ultrasonic transducers (CMUTs) are electrostatic actuators/transducers, which are widely used in various applications. Ultrasonic transducers can operate in a variety of media including liquids, solids and gas. Ultrasonic transducers are commonly used for medical imaging for diagnostics and therapy, biochemical imaging, non-destructive evaluation of materials, sonar, communication, proximity sensors, gas flow measurements, in-situ process monitoring, acoustic microscopy, underwater sensing and imaging, and numerous other practical applications. A typical structure of a CMUT is a parallel plate capacitor with a rigid bottom electrode and a movable top electrode residing on or within a flexible membrane, which is used to transmit (TX) or receive/detect (RX) an acoustic wave in an adjacent medium. A direct current (DC) bias voltage may be applied between the electrodes to deflect the membrane to an optimum position for CMUT operation, usually with the goal of maximizing sensitivity and bandwidth. During transmission an alternating current (AC) signal is applied to the transducer. The alternating electrostatic force between the top electrode and the bottom electrode actuates the membrane in order to deliver acoustic energy into the medium surrounding the CMUT. During reception an impinging acoustic wave causes the membrane to vibrate, thus altering the capacitance between the two electrodes.

Because the electrostatic force in the CMUT is nonlinear, then as the separation space between the two electrodes decreases during actuation, the electrostatic force between the electrodes typically increases at a greater rate than a restorative force of the membrane. Therefore, when the movable electrode displaces to a certain position, e.g., typically one-third of the electrode gap, the restorative force of the membrane is not able to balance the electrostatic force. Any further voltage increase can cause a "pull-in" effect that can result in instability or collapse of the CMUT. Consequently, in order to achieve enough displacement for certain applications, the separation gap between the two electrodes has to be designed to be much larger than the displacement actually required, which can fundamentally limit performance of CMUTs in a conventional operation.

BRIEF DESCRIPTION OF THE DRAWINGS

The accompanying drawing figures, in conjunction with the description, serve to illustrate and explain the principles of the best mode presently contemplated. In the figures, the left-most digit of a reference number identifies the figure in which the reference number first appears. In the drawings, like numerals describe substantially similar features and components throughout the several views.

DETAILED DESCRIPTION

Figure 1A:
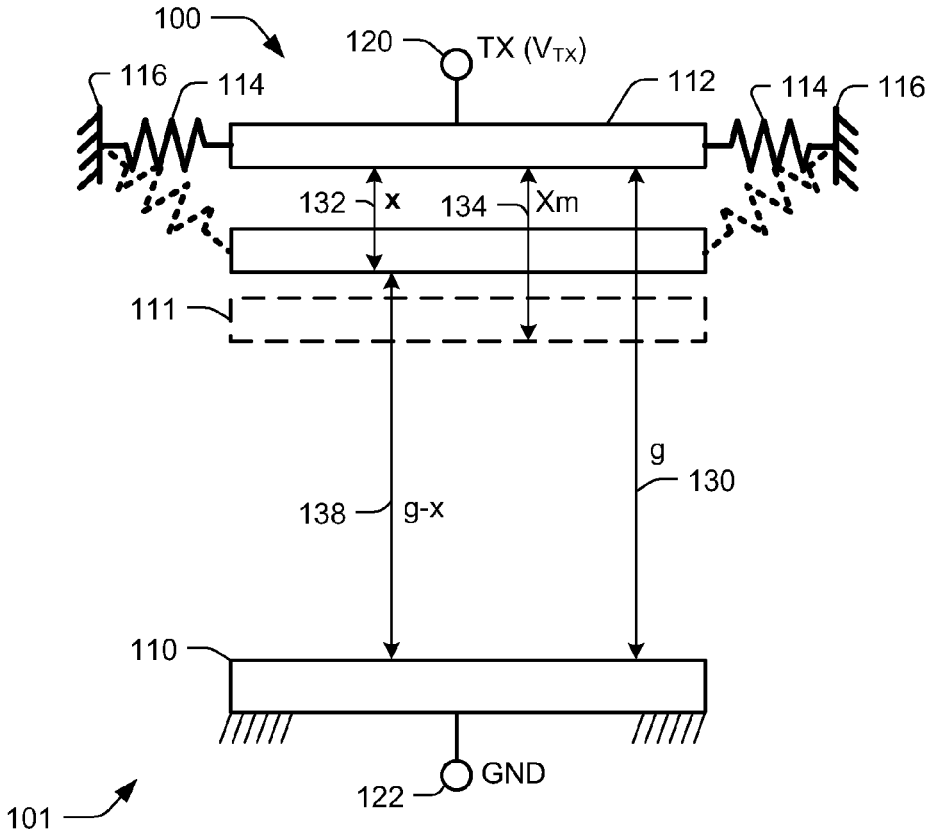
FIGS. 1A-1B illustrate an exemplary schematic model of a system including a theoretical CMUT.

In the following detailed description, reference is made to the accompanying drawings which form a part of the disclosure, and in which are shown by way of illustration, and not of limitation, exemplary implementations. Further, it should be noted that while the description provides various exemplary implementations, as described below and as illustrated in the drawings, this disclosure is not limited to the implementations described and illustrated herein, but can extend to other implementations, as would be known or as would become known to those skilled in the art. Reference in the specification to "one implementation", "this implementation" or "these implementations" means that a particular feature, structure, or characteristic described in connection with the implementations is included in at least one implementation, and the appearances of these phrases in various places in the specification are not necessarily all referring to the same implementation. Additionally, in the description, numerous specific details are set forth in order to provide a thorough disclosure. However, it will be apparent to one of ordinary skill in the art that these specific details may not all be needed in all implementations. In other circumstances, well-known structures, materials, circuits, processes and interfaces have not been described in detail, and/or may be illustrated in block diagram form, so as to not unnecessarily obscure the disclosure.

Implementations disclosed herein relate to CMUTs and methods and systems for design and operation of CMUTs that a component (e.g. a capacitor, a resistor, an inductor, etc.) is added to provide a feedback on the voltage applied on the CMUT. Usually the presence of the added component reduces the percentage of the input voltage applied on the CMUT when the capacitance of the CMUT increases. Thus the added component provides a feedback on the percentage of the input voltage applied on the CMUT. The presence of the added component provides a number of advantages, including improving the displacement and output power of the CMUTs without increasing the electrode separation, improving the device reliability for electric shorting or breakdown by decreasing the absolute voltage applied on the CMUT structure, and improving the reception sensitivity by increasing the capacitance of the CMUT structures. In order to efficiently provide a negative feedback on the percentage of the input voltage applied on the CMUT, the electrical value of the added component should be carefully selected so that the component can provide a desired feedback on the voltage applied to the CMUT in the CMUT's operating frequency region. Implementations may be incorporated into ultrasound systems, transducers, probes, and the like.

In order to solve the issues in CMUT operation and improve CMUT performance, some implementations disclosed herein comprise a component which is a capacitor, referred to herein as a feedback capacitor, with a specially selected capacitance placed in series with the CMUT that provides a feedback on the percentage of the input voltage applied on the CMUT during CMUT operation, and especially during operation of a CMUT in a transmission mode (i.e., producing ultrasonic energy). Some exemplary implementations relate to using a feedback capacitor to provide a negative feedback on the percentage of the input voltage applied on the CMUT. For example, in some implementations, the feedback capacitor is a capacitor in series with the CMUT transducer. The series capacitor and the CMUT may form a voltage divider so that an increase of the capacitance of the CMUT decreases the percentage of the input voltage applied on the CMUT. Thus, the series capacitor has a capacitance chosen to provide a predictable level of negative feedback on the voltage applied on the CMUT. Because the feedback capacitor decreases the percentage of the input voltage applied on the CMUT when the membrane displacement, as well as capacitance, increases, the CMUT can operate beyond the limit set by the conventional pull-in effect. Thus the maximum displacement of the CMUT in operation methods and implementations disclosed herein (e.g., in series with a feedback capacitor) may be larger than that of the same CMUT in a conventional operation (without the added feedback capacitor), or the space separating the electrodes may be designed to be substantially smaller to achieve the same maximum displacement as a CMUT with a larger electrode separation in a conventional operation.

In some implementations, in order to provide an efficient feedback, the capacitance of the feedback capacitor is comparable to the capacitance of the CMUT so that the input voltage can be meaningfully distributed between the CMUT and the feedback capacitor. In some implementations, the capacitance of the feedback capacitor is within a prescribed range based on the capacitance of the CMUT. Additionally, in some implementations, the feedback capacitor may be configured to be functional only during the CMUT transmission (TX) operation. Further, in some implementations, a bias voltage may be applied to the CMUT having the feedback capacitor. In some implementations, the bias voltage may be applied on the CMUT only in RX operation. In addition, in some implementations, a decoupling capacitor may also be used in the bias circuit which is connected with the CMUT having the feedback capacitor.

Other electronic components (e.g., a resistor, an inductor, etc.) with a specified value can be used to replace the feedback capacitor used in some implementations to provide a feedback on the voltage applied on the CMUT. However, unlike the feedback capacitor, the feedback provided by other electronic components may be frequency-dependent, which may not be desirable in some applications. Therefore, while the feedback capacitor, which is not frequency-dependent, is used to illustrate many implementations disclosed herein, it should be noted that implementations using other components to provide the feedback function in CMUT operation are also within the scope of the disclosure.

FIG. 1A illustrates an exemplary system 101 including a schematic model of a theoretical CMUT 100 in transmission operation for illustrating principles of exemplary implementations disclosed herein. The CMUT 100 comprises a fixed electrode 110, a movable electrode 112, equivalent springs 114 and spring anchors 116. The top and bottom electrodes may connect to an interface circuit that includes a first port 120 that receives a transmission input voltage ($V_{TX}$) in this implementation and a second port 122 that acts a ground (GND) in this implementation. Usually the first port 120 is connected to the front circuit (not shown) of the CMUT system. The front circuit of the CMUT either applies an actuation signal ($V_{TX}$) on the CMUT 100 or detects the reception signal from the CMUT 100. CMUT 100 is designed with an electrode separation gap "g" 130, which is the space that exists between the movable electrode 112 and the fixed electrode 110 when the CMUT 100 is in an original position, not activated by a transmission voltage or external acoustic energy. For example, when CMUT 100 is activated by a voltage applied at first port 120, the movable electrode 112 displaces toward the fixed electrode 110 to a certain displacement position x 132 due to the electrostatic force between the movable electrode 112 and the fixed electrode 110. When a voltage is applied to displace movable electrode 112 toward the fixed electrode 110, springs 114 (or equivalent structure) provide a restorative force to return the movable electrode 112 back toward its original position.

However, since the electrostatic force in the CMUT is nonlinear, the electrostatic force can increase faster than the restorative force of springs 114 as the separation between the two electrodes becomes smaller. Consequently, at a certain maximum displacement Xm 134, the restorative force of springs 114 cannot overcome the electrostatic force between the movable electrode 112 and the fixed electrode 110. Once this maximum displacement point Xm 134 is reached, any further voltage increase may cause the movable electrode 112 to collapse on the fixed electrode 110. Therefore, the displacement x 132 of the movable electrode needs to be controlled so as to remain smaller than Xm 134 for a normal CMUT operation. Typically, the maximum design displacement Xm 134 is much smaller than the electrode separation gap g 130. For example, for an ideal parallel plate CMUT in a static actuation, Xm 134 may typically be about one third of separation gap g 130. Therefore, in conventional designs, in order to achieve sufficient displacement for certain applications, the separation gap g 130 between the fixed and movable electrodes needs to be designed to be much larger than the displacement x 132 actually required to produce the desired amount of acoustic energy.

Figure 1B:
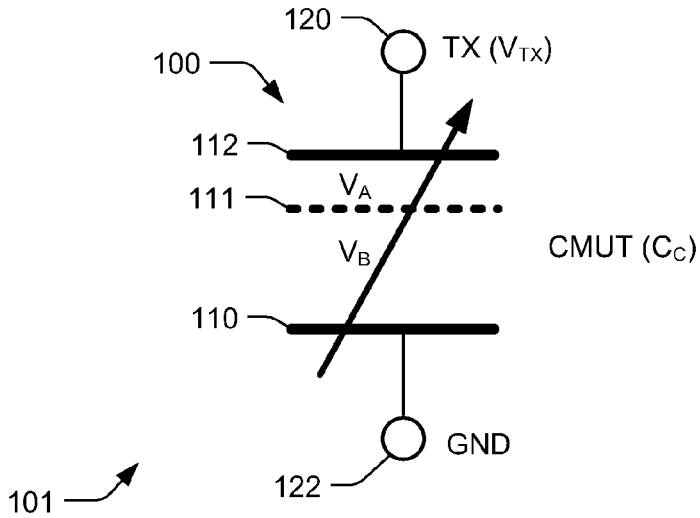

FIG. 1B shows system 101 as an equivalent circuit of the CMUT 100 in FIG. 1A. The CMUT 100 is symbolically represented in this implementation as a variable capacitor. The capacitance of the CMUT 100 is proportional to 1/g. In the illustrated implementation, all of the input voltage $V_{TX}$ may be applied on the CMUT 100.

Figure 2A:
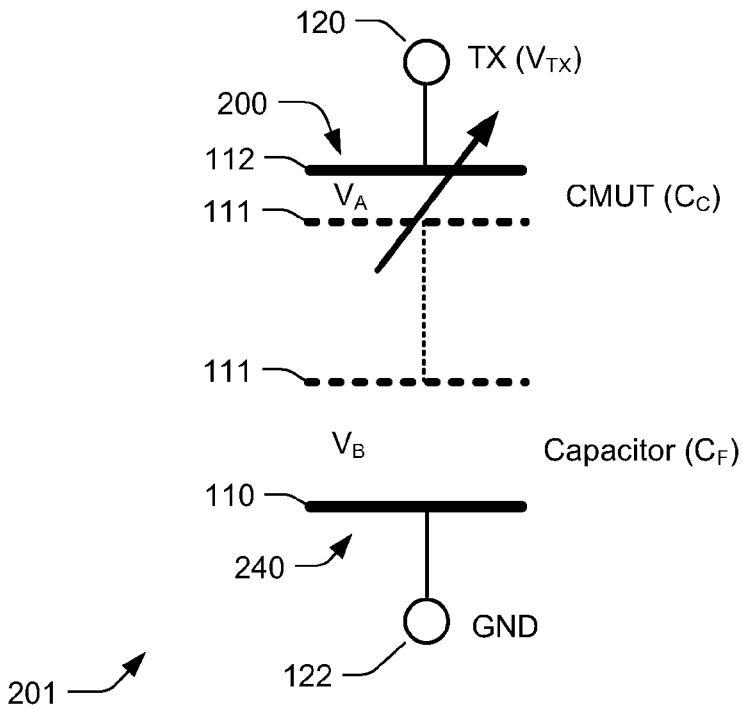
FIGS. 2A-2B illustrate an exemplary implementation of a system including a CMUT with a feedback capacitor.
Figure 2B:
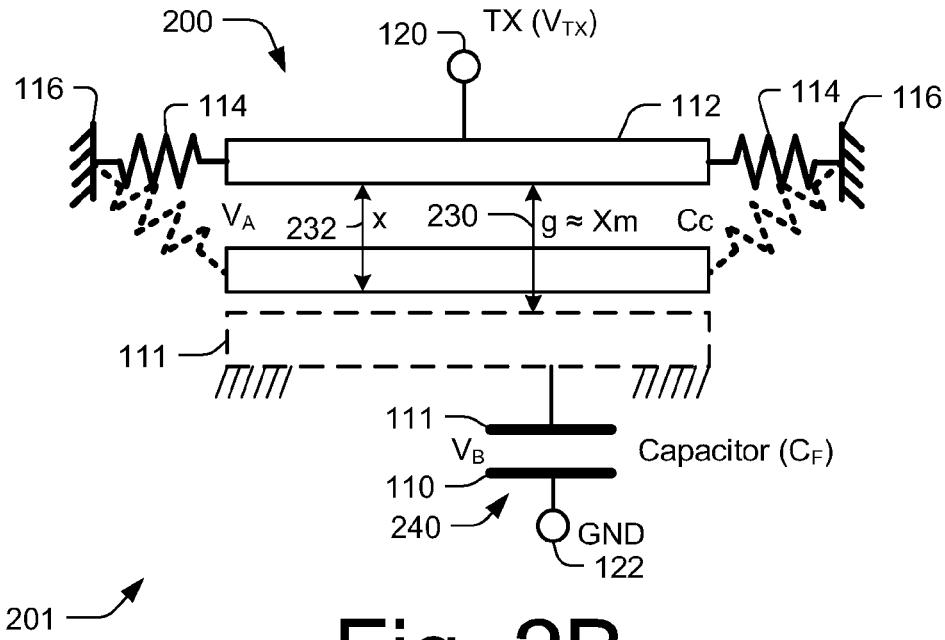

Since the movable electrode 112 has the displacement, x 132, smaller than Xm 134 during a normal operation, CMUT 100 in FIG. 1A can be conceptually separated into two parts by inserting a virtual floating electrode 111 fixed at Xm 134, as also shown in FIG. 1B. Thus, the movable electrode 112 and the floating electrode 111 form another variable capacitor 200 (as shown in system 201 in FIG. 2A) and the floating electrode 111 and the fixed capacitor 110 form a constant capacitor 240 (as shown in FIG. 2A). As disclosed herein, the circuits in FIG. 1B and FIG. 2A may have identical electrical and acoustical properties. FIG. 2B illustrates a schematic model of an exemplary implementation of the system 201 in FIG. 2A. A CMUT 200 having a capacitor 240 connected in series. However, the initial capacitance of the CMUT 200 in FIGS. 2A-2B is g/Xm times of the initial capacitance of the CMUT 100 in FIGS. 1A-1B and the capacitance of the capacitor 240 in FIGS. 2A-2B is g/(g−Xm) times of the initial capacitance of the CMUT 100 in FIGS. 1A-1B. So the capacitances of both the CMUT 200 and the capacitor 240 are larger than that of the CMUT 100 and the total initial capacitance of two series capacitors (i.e., CMUT 200 and capacitor 240) in FIGS. 2A-2B is the same as the initial capacitance of the CMUT 100 in FIGS. 1A-1B.

Since the acoustic and mechanical properties of the circuits or schematic models in FIGS. 1A-1B and FIGS. 2A-2B are the same, so in the CMUT 200 in FIGS. 2A-2B, ideally, the movable electrode 112 can have a maximum displacement Xm that is the same as the whole electrode separation g 230 of the CMUT 200. Therefore, the relative displacement over the electrode separation of a CMUT 200 with a proper capacitor 240 connected in series can be much larger than that of the same CMUT without a capacitor in series. This is because the feedback capacitor 240 (having a capacitance referred to hereafter as "$C_F$") provides a feedback on the percentage of the input voltage applied on the CMUT 200. In FIGS. 1A-1B, all input voltage $V_{TX}$ is applied on the CMUT 100. However, in FIGS. 2A-2B, only part of the input voltage ($V_A$) is applied on the CMUT and rest of the input voltage ($V_B$) is applied on the feedback capacitor, i.e., $V_{TX}=V_A+V_B$. Capacitor 240 and CMUT 200 together form a voltage divider so that an increase of the capacitance, as well as displacement, of the CMUT 200 decreases the percentage of the voltage applied on the CMUT 200, thus capacitor 240 provides a negative feedback on the voltage applied on the CMUT 200. Therefore, when connected in series with capacitor 240, CMUT 200 is able to operate stably well beyond the limits set by the pull-in effect in CMUTs in normal operation (i.e., without a series feedback capacitor).

Further, in the implementation of FIGS. 2A-2B, the CMUT capacitance of CMUT 200 is substantially larger than the capacitance of the theoretical model CMUT 100 of FIG. 1 for achieving the same displacement x 232 of movable electrode 112. The larger CMUT capacitance is desirable to improve the performance of the CMUT, for example, when the CMUT is used in a detect/receive mode for detection/reception of acoustic energy.

In implementations disclosed herein, capacitor 240 may be any kind of capacitor having a constant capacitance. For example, capacitor 240 may be fabricated directly on a CMUT substrate, such as by using metal or silicon as top and bottom electrodes and using nitride or oxide as the dielectric material. Alternatively, capacitor 240 may be a discrete capacitor component connected to a CMUT transducer designed according to the principles and techniques described herein.

Figure 3:
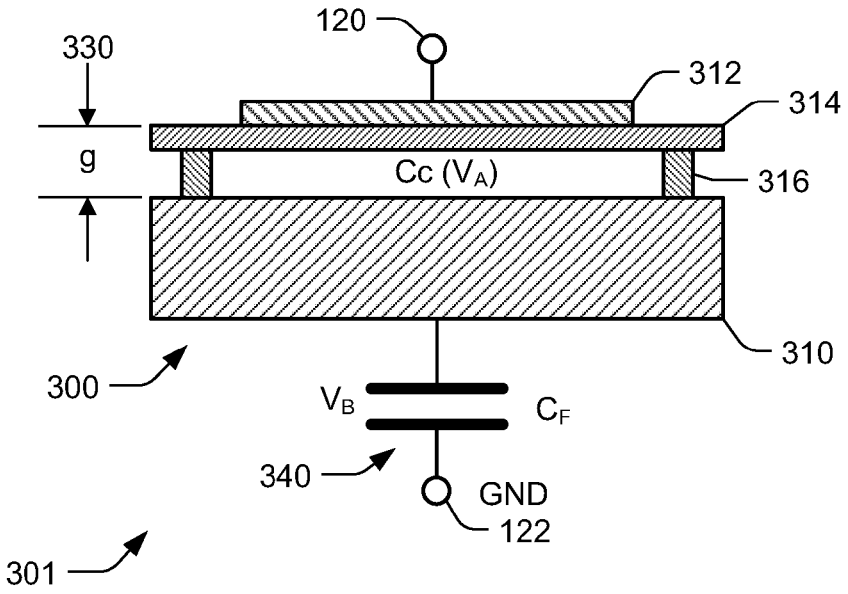
FIG. 3 illustrates another exemplary implementation of a system including a CMUT with a feedback capacitor.

FIG. 3 illustrates an exemplary implementation of a system 301 including a CMUT 300 and a feedback capacitor 340 incorporating principles discussed above. The basic structure of CMUT 300 is a flexible membrane capacitive micromachined transducer having a rigid first electrode 310 and a second electrode 312 residing on, or within or as part of a flexible spring element 314, which may be a flexible membrane or other structure that acts as a spring for enabling second electrode 312 to move toward first electrode 310 when a voltage is applied and then return second electrode 312 to an original position. Spring element 314 and second electrode 312 are separated from first electrode 310 by support anchors 316 to create a transducing separation gap g 330. CMUT 300 may be used to transmit (TX) or detect (RX) an acoustic wave in an adjacent medium through the deflection of flexible membrane 314. For example, during transmission an AC signal is applied to CMUT 300 via first port 120. The alternating electrostatic force between the first electrode 310 and the second electrode 312 actuates the membrane 314 in order to deliver acoustic energy into a medium surrounding the CMUT 300. Similarly, during reception an impinging acoustic wave vibrates the membrane 314, thus altering the effective capacitance between the two electrodes 310, 312, and an electronic circuit (not shown) detects and measures this capacitance change for using the CMUT as a sensor.

The exemplary CMUT 300 of FIG. 3 includes feedback capacitor 340 connected in series to one of electrodes 310 or 312. Feedback capacitor 340 has a capacitance that is preferably approximately equal to or less than an effective capacitance $C_C$ of CMUT 300, such as within the ranges discussed below. By the inclusion of feedback capacitor 340 in series with the CMUT 300, while still achieving the similar maximum displacement, separation gap 330 may be able to be designed to be less than one-half to one-third of the size that would be required in a CMUT without feedback capacitor 340. Feedback capacitor 340 may be fabricated directly on the same CMUT substrate as one of first or second electrodes 310, 312, respectively, or alternatively, capacitor 340 may be connected to CMUT 300 as a discrete capacitor component.

Figure 4:
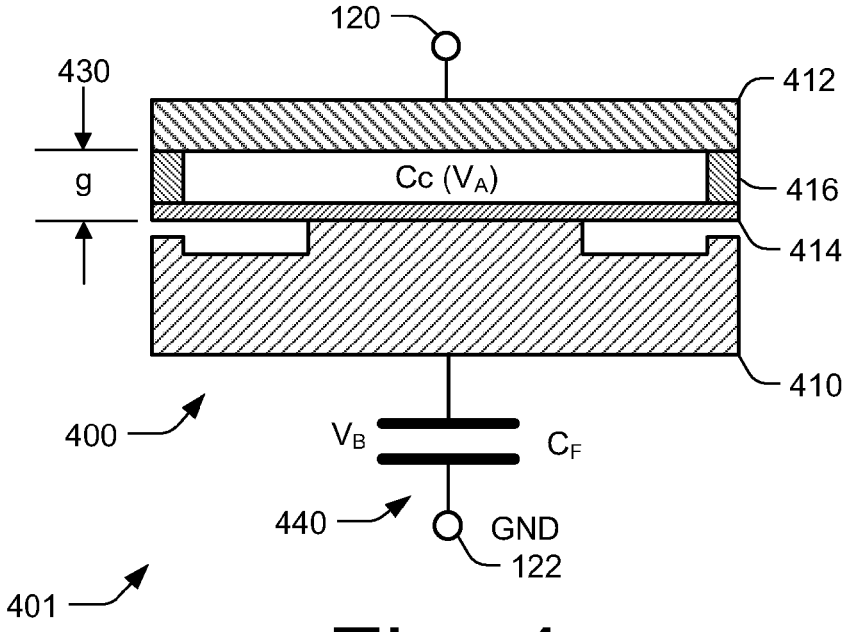
FIG. 4 illustrates another exemplary implementation of a system including a CMUT with a feedback capacitor.

FIG. 4 illustrates another implementation of an exemplary system 401 including a CMUT 400 with a feedback capacitor 440 connected in series. CMUT 400 includes a first electrode 410 and a second electrode 412. CMUT 400 includes an embedded spring element 414, which may be a flexible membrane or other structure that acts as a spring for enabling second electrode 412 to move toward first electrode 410 and then spring back to an original position. Moreover, spring element 414 may be conductive and be a part of the first electrode 410. Second electrode 412 may be suspended from spring element 414 by supports 416 to create a transducing separation gap g 430. CMUT 400 may be operated in a manner similar to that described above for CMUT 300.

The exemplary CMUT 400 of FIG. 4 includes feedback capacitor 440 connected in series to one of electrodes 410 or 412. Feedback capacitor 440 has a capacitance that preferably is approximately equal to or less than an effective capacitance $C_C$ of CMUT 400, such as within the ranges discussed below. By the inclusion of capacitor 440 in series with the CMUT 400, while still achieving the similar maximum displacement, separation gap 430 is able to be designed to be less than one-half to one-third of the size that would be required in a CMUT in normal operation. Capacitor 440 may be fabricated directly on the same CMUT substrate as one of first or second electrodes 410, 412, respectively, or alternatively, capacitor 440 may be connected to CMUT 400 as a discrete capacitor component.

Figure 5A:
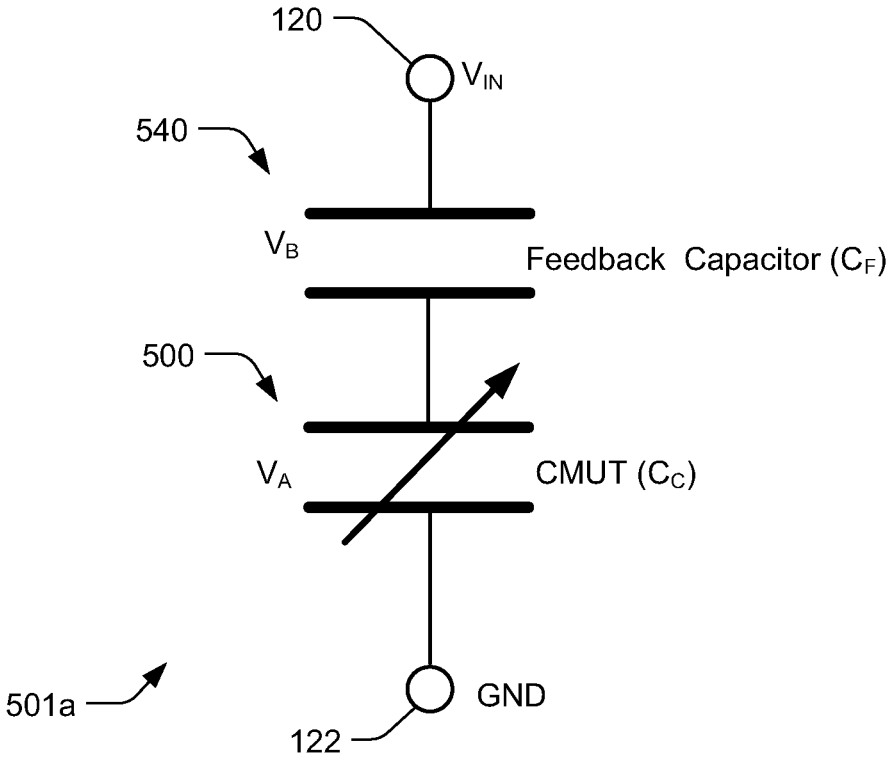
FIGS. 5A-5C illustrate exemplary implementations of systems including CMUTs with feedback components.

FIG. 5A is a schematic to depict the basic configuration of a system 501 including a CMUT 500 according to some implementations. A feedback capacitor 540 having a capacitance $C_F$ is connected in series with the CMUT 500 having a capacitance $C_C$. The second port 122 is connected to a GND or a bias source. The first port 120 is connected to the front circuit (not shown) of the CMUT system. The front circuit of the CMUT either applies an actuation signal (V) on the CMUT 500 with a feedback capacitor 540 in series or detects the reception signal from the CMUT 500. Usually, the implementations of using a feedback capacitor provide more advantages in transmission operation of a CMUT than in detect/receive operation and, therefore, we use the transmission operation to illustrate the implementations in FIG. 5A. In this case, the input voltage $V_{IN}$ is the transmission signal $V_{TX}$. The voltage $V_A$ applied on the CMUT 500 from a transmission signal $V_{TX}$ can be obtained as: $V_A=V_{TX}-V_B=V_{TX}(1+(C_C/C_F))^{-1}$. For a given applied input signal $V_{TX}$, the voltage $V_A$ applied on the CMUT decreases as the capacitance $C_C$ of the CMUT increases. Therefore the series capacitor 540 provides a negative feedback on the voltage $V_A$ applied on the CMUT 500.

The efficiency of the feedback provided by the feedback capacitor 540 depends on the ratio of $C_C/C_F$. Therefore, the capacitance of the series capacitor 540 needs to be selected properly to achieve a desired feedback on the input voltage applied on the CMUT 500. In some implementations with properly selected feedback capacitor, the feedback on the input voltage applied on the CMUT 500 is able to extend the CMUT operation range beyond that limited by the pull-in effect in normal CMUT operation. Consequently, the CMUT 500 with the feedback capacitor 540 having a capacitance $C_F$ is able to achieve a larger displacement within a predetermined transducing space than the same CMUT in a normal operation (without feedback capacitors) according to the implementations disclosed herein. For example, in a CMUT model with an ideal parallel plate capacitance arrangement, if the feedback capacitor is selected to have a capacitance $C_F$ that is one-half of the capacitance $C_C$ of the CMUT, then there is no pull-in effect and the maximum displacement Xm of the CMUT can be the same as the electrode separation g of the CMUT, as discussed above with reference to FIGS. 2A and 2B. This enables to design CMUTs having substantially larger capacitance to achieve the same displacement as those designed for a normal CMUT operation, or substantially larger displacements for the same capacitance as those designed for a normal CMUT operation.

As discussed above, the sum of the voltage $V_A$ applied on the CMUT 500 and the voltage $V_B$ applied on the feedback capacitor 540 is equal to the applied transmission voltage $V_{TX}$, i.e., $V_{TX}=V_A+V_B$. In some implementations, $V_B$ is comparable to $V_A$ or even larger than $V_A$. Therefore, the voltage ($V_A$) applied on the CMUT structure disclosed herein is smaller than the voltage ($V_{TX}$) applied on the CMUT structure in normal operation. There are some advantages achieved to having a smaller voltage applied on the CMUT when implementations of CMUTs disclosed herein are implemented in an ultrasound system, such as an ultrasound probe. First, in some implementations, the capacitance of the CMUTs can be designed to be larger than that of a CMUT having comparable displacement without a suitable feedback capacitor. Thus, increasing the capacitance $C_C$ of the CMUTs herein can improve the reception performance of the CMUT. Also, an entire transmission voltage $V_{TX}$ is typically applied on a CMUT in a normal operation (without a feedback capacitor in series). In implementations disclosed herein, however, only a portion of the total voltage (e.g., $V_A<V_{TX}$) is applied on the CMUT, and the remainder of the voltage (voltage $V_B$) is applied on the feedback capacitor. This provides a second advantage for some implementations in which the CMUTs serve as ultrasonic transducers that need to be placed in voltage-sensitive locations to emit the ultrasound to a medium or receive ultrasound from a medium. Because the feedback capacitor 540 may be located anywhere in series with the CMUT 500, the amount of voltage applied to the CMUT itself can be reduced, which can be beneficial to applications where a high voltage is not preferred at the transducer vicinity.

Thus, the voltage ($V_A$) applied on the CMUTs disclosed herein may be much lower than the voltage ($V_{TX}$) applied on a CMUT that does not incorporate a feedback capacitor when both are emitting the same ultrasound power. This is beneficial to the electrostatic breakdown issue in CMUTs discussed above because the voltage $V_A$ applied on the CMUT of implementations disclosed herein is much lower. Moreover, the lower voltage applied on the CMUTs with a feedback capacitor disclosed herein allows for a thinner insulation layer in the CMUT to prevent dielectric breakdown when the two electrodes collapse. Although, ideally, the insulation layer may not be needed in some implementations. This improves the reliability of the CMUT because dielectric charging in the insulation layer is minimized or completely eliminated. Therefore, the CMUT disclosed herein (with a feedback capacitor in series) has much better reliability.

In some implementations, in order to provide the desired feedback on the voltage applied on the CMUT using the capacitor in series, the capacitance $C_F$ of the feedback capacitor should be comparable with the capacitance $C_C$ of the CMUT, for example, within the same order of magnitude. For instance, the capacitance $C_F$ of the feedback capacitor may be designed to be within the range from 0.1 $C_C$ to 3 $C_C$ (i.e., between 10 and 300 percent of $C_C$), where $C_C$ stands for the effective baseline capacitance of a CMUT, or more precisely, the capacitance of the CMUT when the CMUT is set for a transmission operation before any change in the capacitance due to input of a transmission voltage $V_{TX}$. Moreover, in some exemplary implementations, the capacitance $C_F$ of the feedback capacitor may be designed to be within 0.3 $C_C$ to 1 $C_C$ (i.e., between 30 and 100 percent of $C_C$) for optimum operation. Further, in some implementations, capacitance $C_C$ may include both the CMUT capacitance and any parasitic capacitance if there is a parasitic capacitance existing in certain practical installations or in the CMUT structure itself.

Besides using a capacitor, other suitably configured electronic components, e.g., a resistor, an inductor, or the like, may be used in place of the feedback capacitor 540 in FIG. 5A to achieve the desired feedback on the input voltage applied on the CMUT 500. Since the feedback of the components other than a capacitor is frequency-dependent, the value of the electronic component may be selected to have a similar electrical impedance $I_F$ to that of the desired feedback capacitance $C_F$ in the operating frequency of the CMUT 500.

Figure 5B:
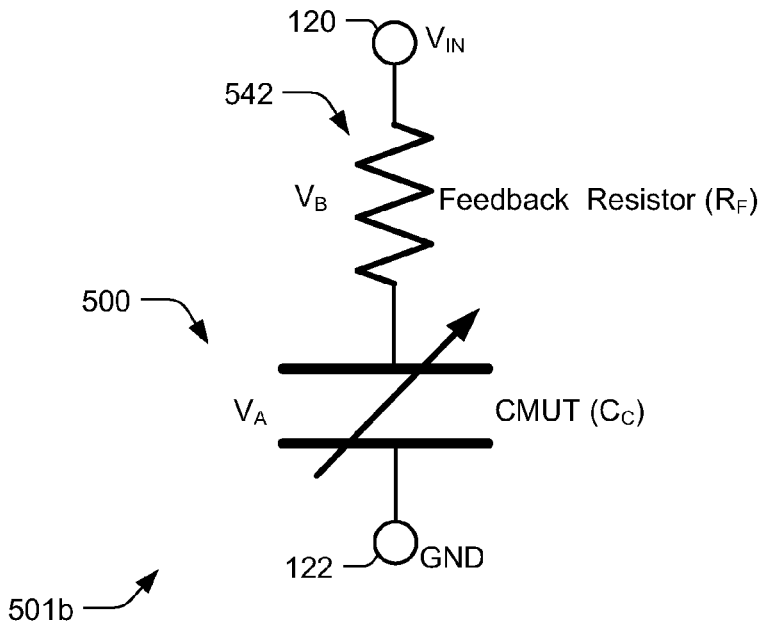

FIG. 5B illustrates a system 501*b* including a CMUT 500 with a feedback resistor 542 connected in series with CMUT 500. The feedback resistor 542 is connected with one of two electrodes of the CMUT 500 and has a selected resistance $R_F$. The second port 122 is connected to a GND or a bias source. The first port 120 is connected to the front circuit (not shown) of the CMUT. The front circuit of the CMUT either applies an actuation signal ($V_{IN}$) on the CMUT 500 with a feedback resistor 542 in series or detects the reception signal from the CMUT 500. The voltage $V_A$ applied on the CMUT 500 from a transmission signal V can be obtained as: $V_A=V_{in}-V_B=V_{in}(1+j\omega_C R_F C_C)^{-1}$, where j is the imaginary unit and $\omega_C$ is the operating frequency of the CMUT. For a given applied input signal $V_{IN}$, the voltage $V_A$ applied on the CMUT decreases as the capacitance $C_C$ of the CMUT increases. Therefore the series resistor 542 having a properly selected resistance $R_F$ provides a negative feedback on the voltage $V_A$ applied on the CMUT 500.

The efficiency of the feedback provided by the feedback resistor 542 depends on a feedback factor of $j\omega_C R_F C_C$. Different from using a feedback capacitor discussed above, the feedback factor of using a feedback resistor is a function of the operating frequency $\omega_C$ of the CMUT. It is also notable that the feedback factor is an imaginary, so there is a phrase difference between the voltage ($V_A$) applied on the CMUT and the input voltage ($V_{IN}$). This phase difference makes the feedback of the resistor 542 on the CMUT 500 to behave as a damping effect on the CMUT displacement. Therefore, the CMUT with a feedback resistor 542 may have a better bandwidth than the CMUT in normal operation. Thus this approach is especially useful to broaden the bandwidth of a CMUT operating in air as a medium. Therefore, the resistance $R_F$ of the series resistor 542 needs to be selected properly to achieve a desired feedback on the input voltage applied on the CMUT 500 in CMUT in the operating frequency region. For example, in order to achieve the similar absolute feedback effect as a feedback capacitor 540 on the voltage ($V_A$) applied on the CMUT 500, the feedback resistor 542 has an impedance $Z_F=R_F$ that is of the same order of magnitude as an impedance $Z_F=1/j\omega_C C_C$ of CMUT 500 based upon a predetermined operating frequency ($\omega_C$) of CMUT 500. For example, the impedance of resistor 542 may be between 50 and 300 percent of the impedance of the CMUT 500 at the predetermined operating frequency.

Figure 5C:
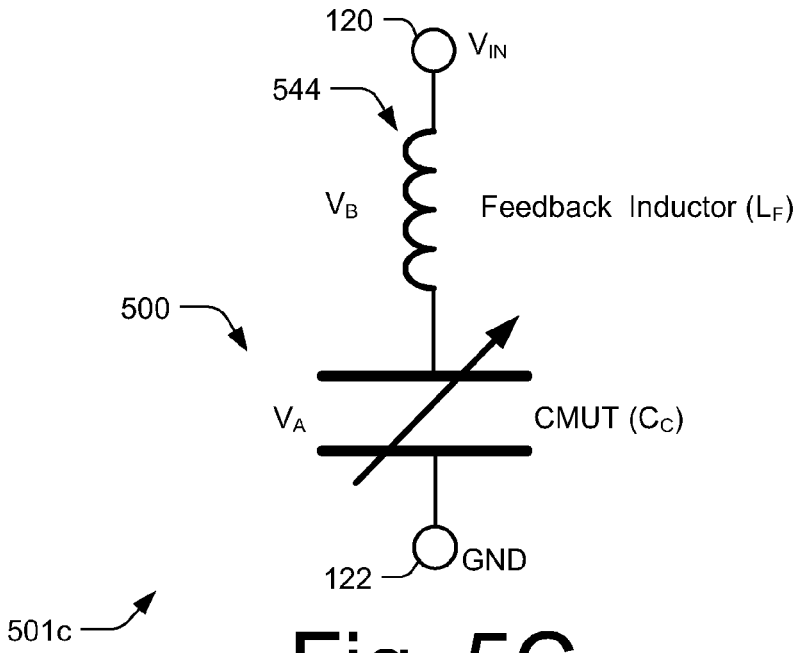

Additionally, FIG. 5C illustrates system 501*c* including a CMUT 500 having a feedback inductor 544 connected in series with CMUT 500. The feedback inductor 544 is connected with one of the two electrodes of the CMUT 500. The second port 122 is connected to a GND or a bias source. The first port 120 is connected to the front circuit (not shown) of the CMUT. The front circuit of the CMUT either applies an actuation signal ($V_{IN}$) on the CMUT 500 with a feedback inductor in series or detects the reception signal from the CMUT 500. The voltage $V_A$ applied on the CMUT 500 from a transmission signal $V_{IN}$ can be obtained as: $V_A=V_{in}-V_B=V_{in}(1+(-\omega_C^2 L_F C_C))^{-1}$. For an applied input signal $V_{IN}$, the percentage of the voltage $V_A$ applied on the CMUT increases as the capacitance $C_C$ of the CMUT increases. Therefore the series inductor 544 provides a positive feedback on the voltage $V_A$ applied on the CMUT 500.

The efficiency of the feedback provided by the feedback inductor 544 depends on a feedback factor of $-\omega_C^2 L_F C_C$. Different from using a feedback capacitor discussed above, the feedback factor of using a feedback inductor 544 is a strong function of the frequency W. It is also notable that the feedback factor is negative so the inductor provides a positive feedback. Thus, the voltage ($V_A$) applied on the CMUT can be larger than the input voltage ($V_{IN}$). The CMUT with the series inductor may have a narrower bandwidth. So this may be useful to applications in which a signal with multiple pulses is needed, e.g., High Intensity Focused Ultrasound (HIFU). The inductance $L_F$ of the series inductor 544 needs to be selected properly to achieve a desired feedback on the input voltage applied on the CMUT 500 in CMUT operating frequency region. For example, in order to achieve the effective feedback effect as a feedback inductor 544 having an inductance $L_F$ on the voltage ($V_A$) applied on the CMUT 500, the feedback inductor 544 has an impedance $Z_F=j\omega_C L_F$ that is of the same order of magnitude as an impedance $Z_F=1/j\omega_C C_C$ of CMUT 500 based upon a predetermined operating frequency ($\omega_C$) of CMUT 500. For example, the impedance $Z_F$ of inductor 544 may be between 50 and 300 percent of the impedance of the CMUT 500 at the predetermined operating frequency.

In the following description and associated drawing figures, feedback capacitors are used to illustrate various implementations disclosed herein, but other feedback components, such as the feedback resistor and feedback inductor discussed above, may be used in the same implementations, taking into account the considerations discussed above.

Figure 6:
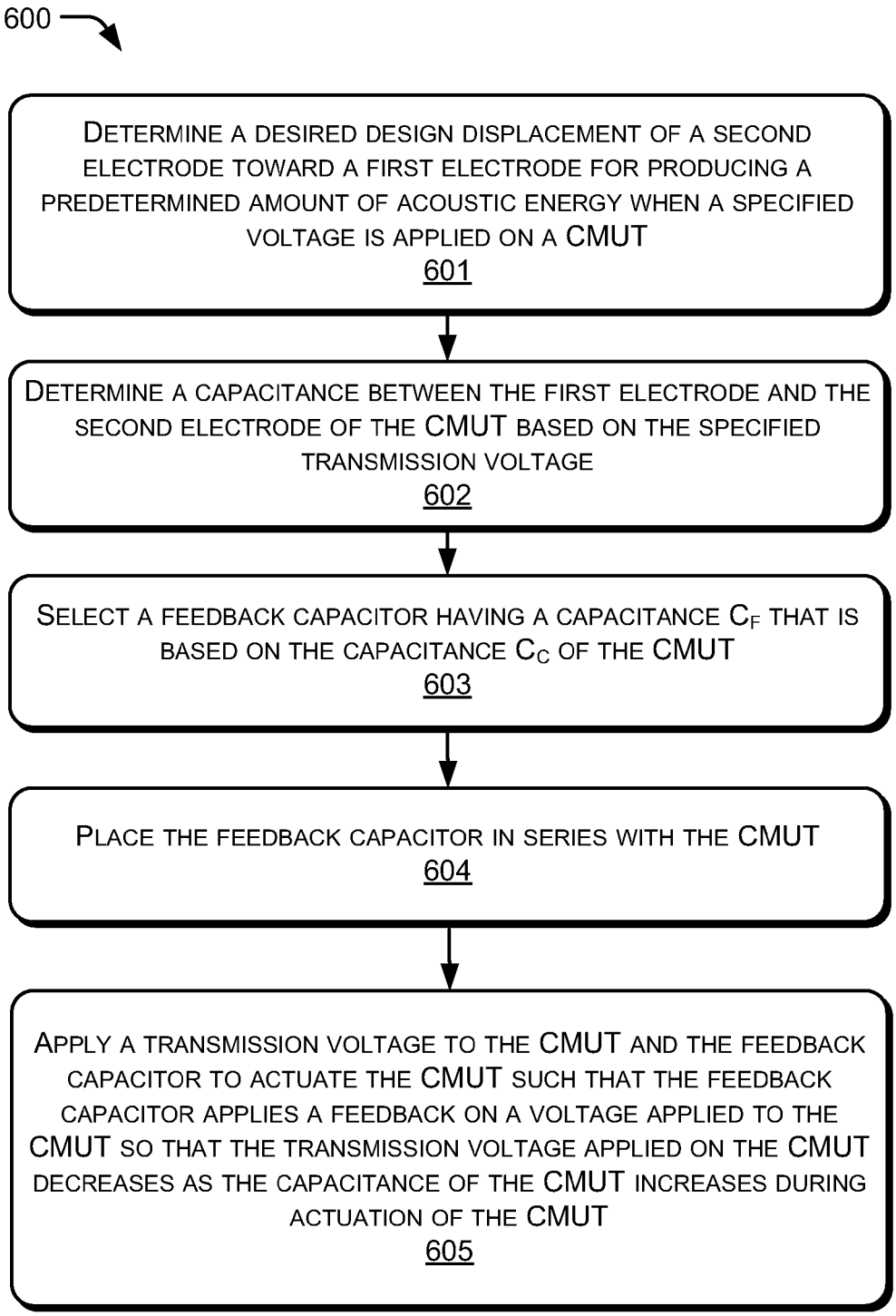
FIG. 6 illustrates a flowchart of an exemplary method for a CMUT with a feedback capacitor.

FIG. 6 illustrates a flow chart 600 of an exemplary method for a CMUT including a feedback capacitor according to implementations described herein. Further, it should be noted that this method is entirely exemplary, and the invention is not limited to any particular method.

Block 601: In some implementations, it is first necessary to determine a desired design displacement x of a second electrode toward a first electrode for producing a predetermined amount of acoustic energy when a specified voltage will be applied on the CMUT.

Block 602: Once the desired displacement x is determined, a capacitance $C_C$ that will exist between the first electrode and the second electrode of the CMUT based on the specified transmission voltage can be determined, as discussed above.

Block 603: After the capacitance $C_C$ of the CMUT has been determined, the feedback capacitor can be selected based on the capacitance $C_C$ of the CMUT. As discussed above, in some implementations the feedback capacitor has a capacitance $C_F$ that is less than or approximately equal to the capacitance $C_C$ of the CMUT. In other implementations, the feedback capacitor is chosen within the specific ranges recited above, i.e., between 30 and 100 percent of the capacitance $C_C$ or between 10 and 300 percent of the capacitance $C_C$.

Block 604: The feedback capacitor is placed in series with the CMUT.

Block 605: A transmission voltage is applied to the CMUT and the feedback capacitor to actuate the CMUT. The transmission voltage causes movement of the second electrode toward and away from the first electrode to produce ultrasonic energy. The feedback capacitor applies a feedback on the voltage applied on the CMUT so that the percentage of the transmission voltage applied on the CMUT decreases as the capacitance $C_C$ of the CMUT increases during actuation of the CMUT, and vice versa.

Figure 7:
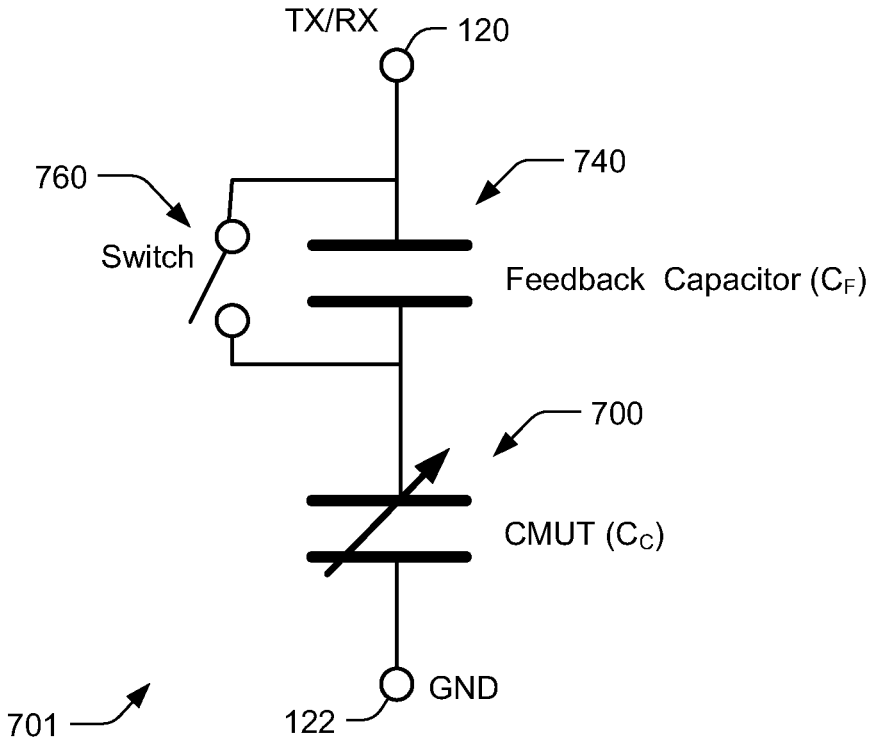
FIG. 7 illustrates another exemplary implementation of a system including a CMUT with a feedback capacitor.

FIGS. 7-13 illustrate more detail implementations of the basic configuration shown in FIG. 5 into different operation methods and configurations of a CMUT. FIG. 7 illustrates an implementation of a system 701 including a CMUT 700 connected in series with a feedback capacitor 740. The second port 122 is connected to a GND or a bias source. The first port 120 is connected to the front circuit (not shown) of the CMUT system. The front circuit of the CMUT either applies an actuation signal on the CMUT 700 or detects the reception signal from the CMUT 700. A switch 760 may be used to short the feedback capacitor 740, such as during a certain duration of the operation CMUT 700. For example, switch 760 may be opened during a transmission (TX) operation and closed during a reception (RX) operation to short the circuit, thereby rendering feedback capacitor 740 active during transmission of ultrasonic energy and inactive during reception of ultrasonic energy. During reception operation, a larger CMUT capacitance is desired to drive a detection signal, so the feedback capacitance is desired to be shorted to increase the overall capacitance. Furthermore, even though switch 760 is not shown in the other exemplary configurations described above and also described below, such a switch may be may be added in any of those implementations if desired. The switch illustrated in FIG. 7 may be a real switch or switch circuit; it may also be any circuit or function box that functions like a switch to include or to exclude the feedback capacitor 740 in certain operation (e.g. TX or RX operation) of the CMUT 700.

Figure 8:
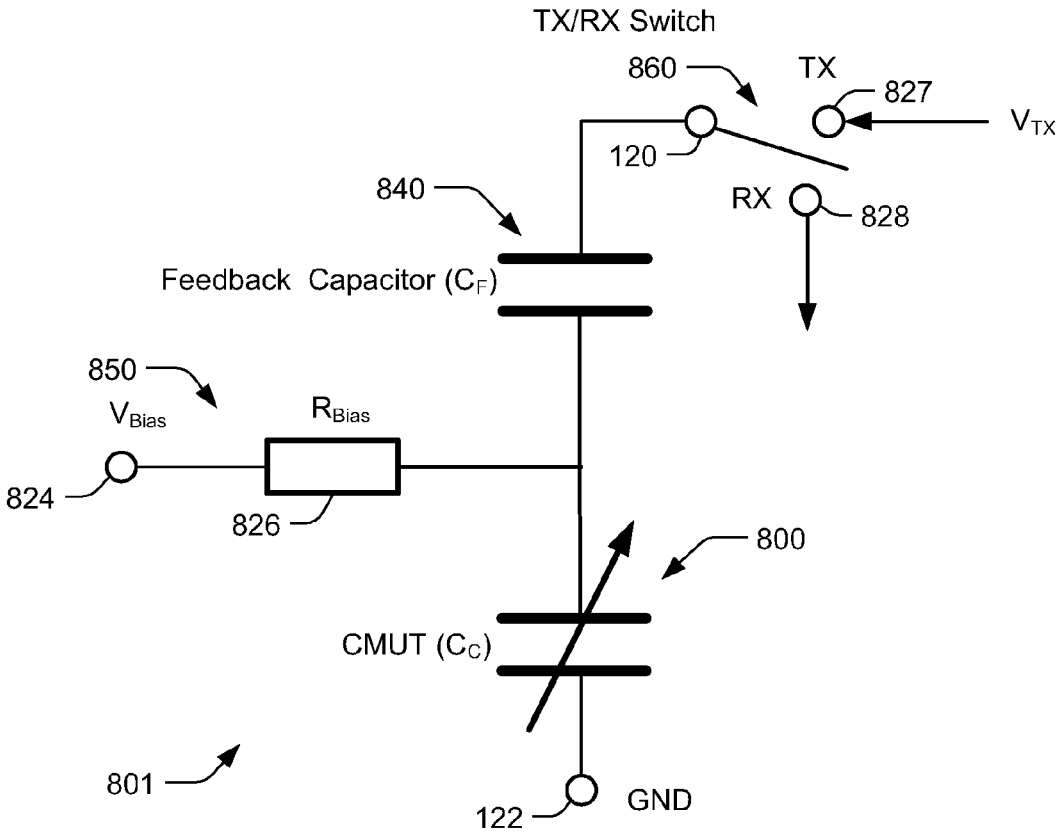
FIG. 8 illustrates another exemplary implementation of a system including a CMUT with a feedback capacitor.

FIG. 8 illustrates an implementation of a system 801 including a CMUT 800 connected in series with a feedback capacitor 840. In this implementation, CMUT 800 is subject to receiving a biasing voltage $V_{Bias}$ at a third port 824 via a bias circuit 850 including a biasing resistor 826 having a resistance $R_{Bias}$. Usually, the resistance of a bias resistor is much larger than the impedance of the CMUT. So the presence the bias resistor, as well as the decoupling capacitor introduced later, has minimal impact on the CMUT operation at the operating frequency of the CMUT. Often, an electrical floating operation point/port should be biased to a desired signal source to achieve stable operation, such as when in a detect/receive mode for receiving an acoustic signal. In the implementation of FIG. 8, there is an electrical floating point between the CMUT 800 and the feedback capacitor 840 so the CMUT 800 may be biased by a bias source $V_{Bias}$ at a third port 824. In some implementations, the bias source may be a DC voltage source, a ground, or any other signal source. In the implementation of FIG. 8, a TX/RX switch 860 is included at first port 120 for switching between transmit mode and receive/detect mode. Thus, when switch 860 switches to a TX input terminal 827, transmission voltage $V_{TX}$ is able to pass to the CMUT 800. Alternatively, when switch 860 switches to an RX output terminal 828, an output current produced by CMUT 800 as a result of receiving or detecting ultrasonic energy is able to be passed to a measuring circuit or the like (not shown).

There are various bias methods which can be used for some implementations disclosed herein. TX/RX switch 860 in the implementations and configurations disclosed herein can be any circuit or function box that functions like a switch between transmission (TX) operation and reception (RX) operation. For example, TX/RX switch 860 may be an actual physical switch, may be a protective circuit for preamplification of reception during transmission operations, or some other arrangement that performs the same function.

FIG. 8 illustrates an exemplary method to bias CMUT 800 and feedback capacitor 840. The bias voltage $V_{Bias}$ that is applied on the CMUT 800 may be delivered through bias resistor 826. The feedback capacitor 840 is able to perform a feedback function as discussed above, and is also able to perform a DC decoupling function in some implementations so that a DC decouple capacitor is not needed in addition to the feedback capacitor 840. Further, for all configurations described herein, the biasing resistor having $R_{Bias}$, which is used to apply the proper bias, may be replaced by a switch.

In the implementation of FIG. 8, both the feedback capacitor 840 and the bias voltage $V_{Bias}$ are placed between the CMUT 800 and the TX/RX switch 860. However, FIG. 9 illustrates an alternative implementation of a system 901 in which a CMUT 900 receives the bias voltage $V_{Bias}$ via third port 824 and bias circuit 850, and a feedback capacitor 940 is located on the other side of TX/RX switch 860 at input terminal 827, so that feedback capacitor 940 only functions during TX operations.

Figure 10:
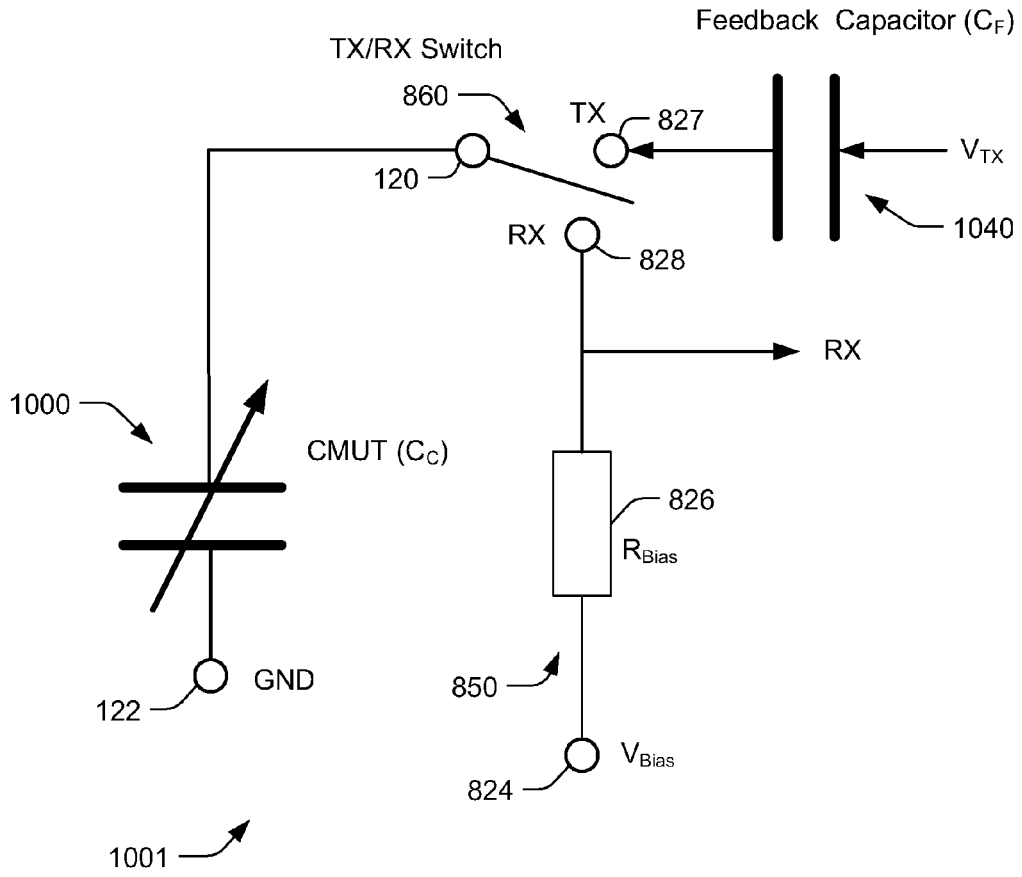
FIG. 10 illustrates another exemplary implementation of a system including a CMUT with a feedback capacitor.

FIG. 10 illustrates another implementation of a system 1001 including a CMUT 1000 in which the bias circuit 850 providing $V_{Bias}$ is also located on the other side of TX/RX switch 860 at output terminal 828, so that $V_{Bias}$ 824 only functions during RX operation mode and a feedback capacitor 1040 only functions during transmission mode.

Figure 11:
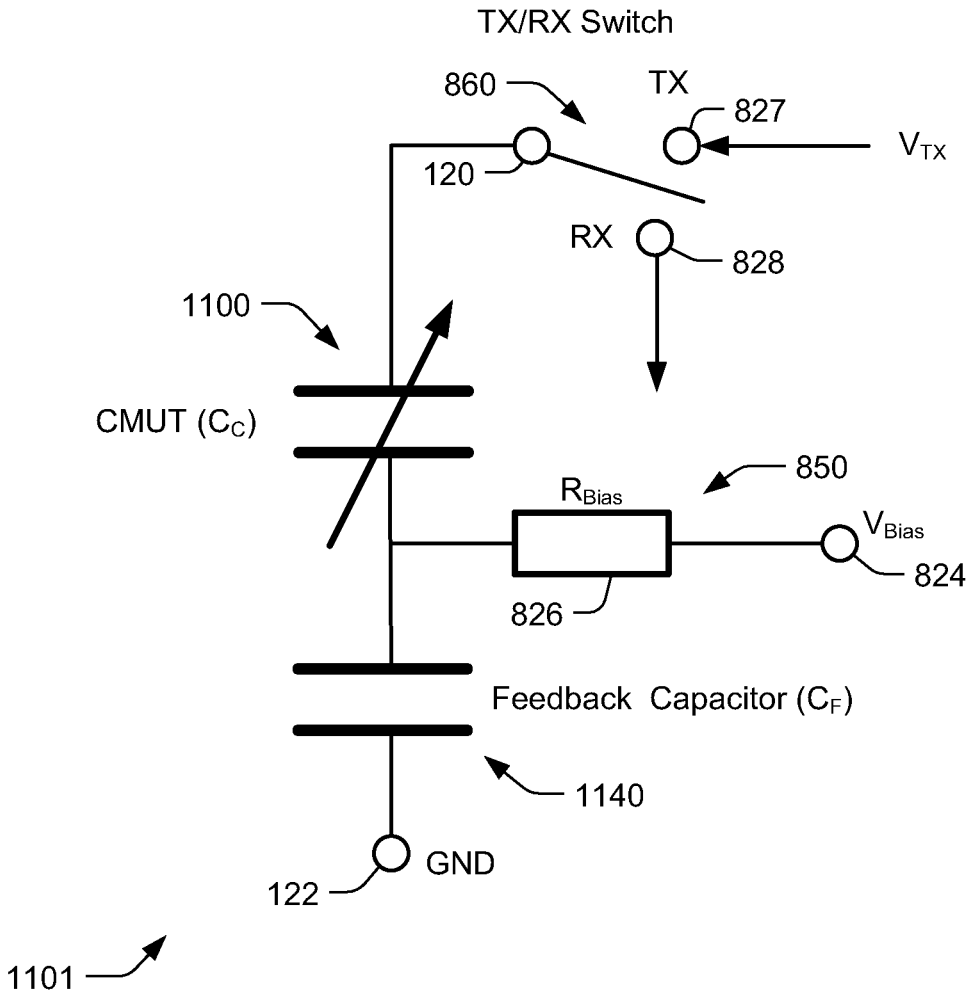
FIG. 11 illustrates another exemplary implementation of a system including a CMUT with a feedback capacitor.

Additionally, in the implementation of FIG. 8, feedback capacitor 840 is placed between CMUT 800 and TX/RX switch 860. In that configuration, the operation point of the CMUT is determined by the bias voltage only. However, in other implementations, the feedback capacitor can be placed on the other side of the CMUT, as illustrated in FIG. 11. In FIG. 11, a system 1101 including a feedback capacitor 1140 and the bias circuit 850 are located between a CMUT 1100 and second port 122, which also serves as ground in this implementation. The operation point of CMUT 1100 of FIG. 11 may be determined by the bias voltage $V_{Bias}$ only, or by both the bias voltage $V_{Bias}$ and transmission (TX) input signal voltage $V_{TX}$ when switch 860 is in contact with TX input terminal 827.

Figure 9:
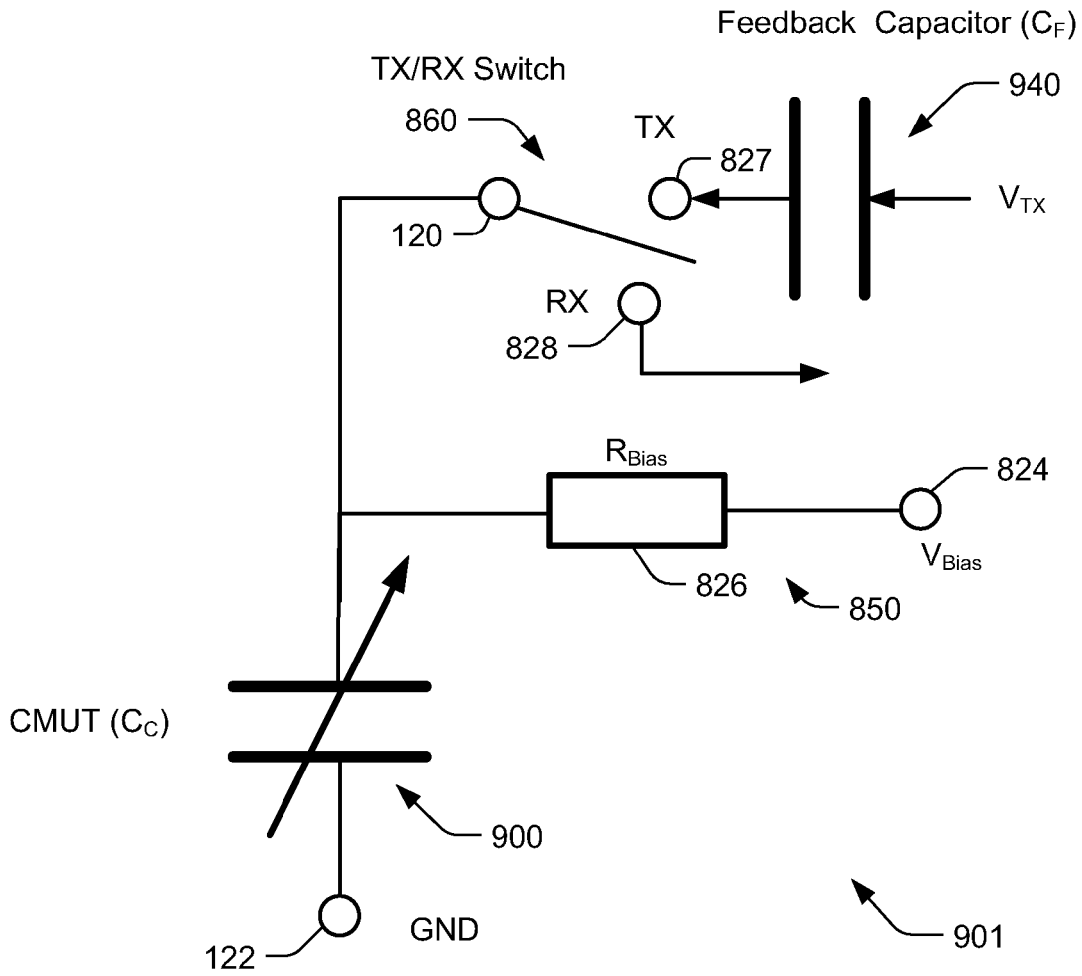
FIG. 9 illustrates another exemplary implementation of a system including a CMUT with a feedback capacitor.
Figure 12:
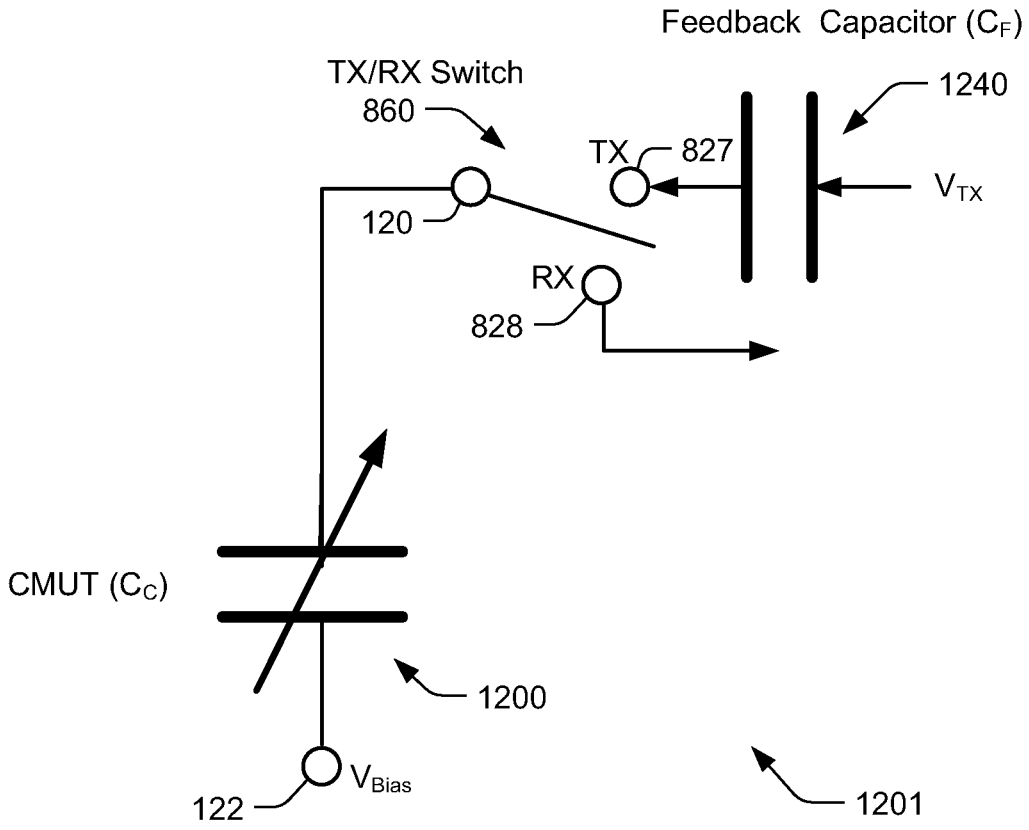
FIG. 12 illustrates another exemplary implementation of a system including a CMUT with a feedback capacitor.

Also, in the implementation of FIG. 9, the bias circuit 850 is placed between the CMUT 900 and the TX/RX switch 860. However, as illustrated in FIG. 12, the bias voltage $V_{Bias}$ can be also placed on the other side of the CMUT. FIG. 12 illustrates an implementation of a system 1201 in which a CMUT 1200 is connected directly to a source of bias voltage through second port 122, and feedback capacitor 1240 is only connected during a transmission mode.

Figure 13:
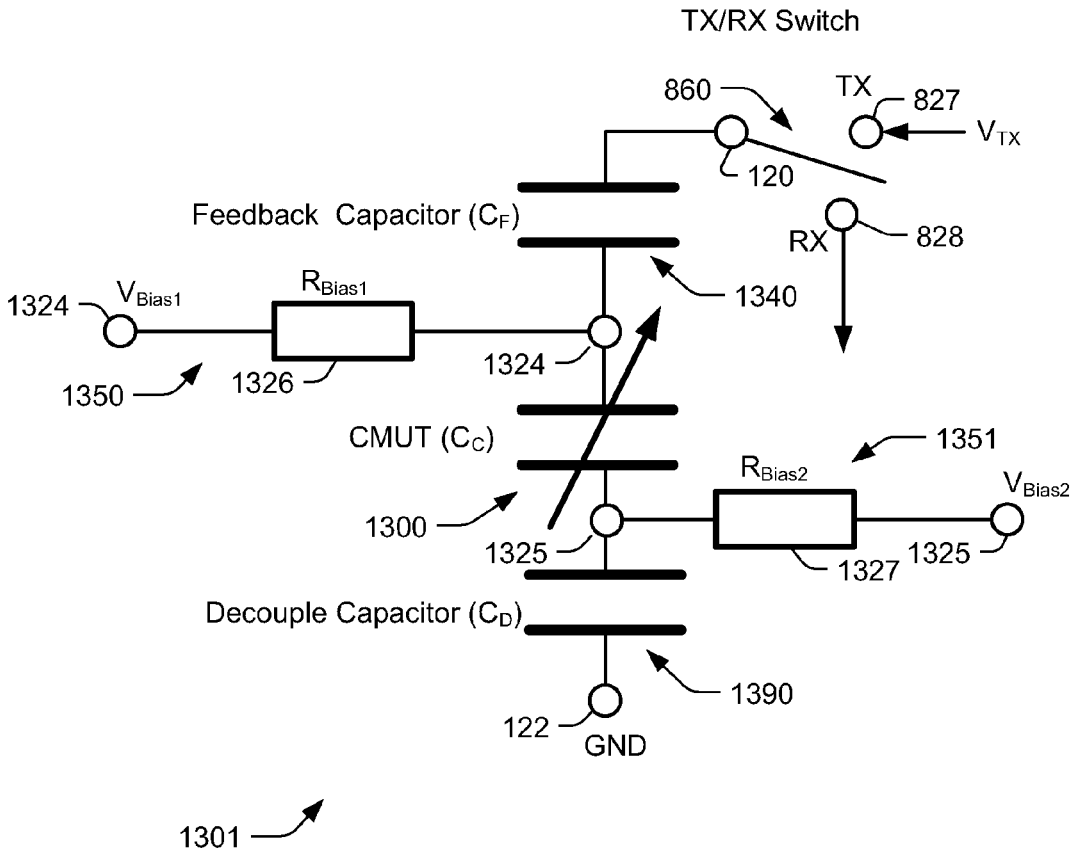
FIG. 13 illustrates another exemplary implementation of a system including a CMUT with a feedback capacitor.

FIG. 13 illustrates an implementation of a system 1301 in which two bias circuits 1350, 1351 are placed on the two sides of a CMUT 1300, respectively. The first bias circuit 1350 having a voltage $V_{Bias1}$ is provided at a third port 1324 and is applied through a first biasing resistor 1326 having a resistance $R_{Bias1}$ applied between the CMUT 1300 and a feedback capacitor 1340. The second bias circuit 1351 having a voltage $V_{Bias2}$ is provided at a fourth port 1325 and is applied through a second biasing resistor 1327 having a resistance $R_{Bias2}$ applied on the other side of CMUT 1300. Further, a decoupling capacitor 1390 may be included on this side of CMUT 1300 between CMUT 1300 and second port 122. Thus, the implementation of FIG. 13 includes a decoupling capacitor 1390 in series with CMUT 1300 in addition to feedback capacitor 1340. For example, decoupling capacitor 1390 is a decoupling capacitor having a capacitance $C_D$ that is typically selected to be much larger than the capacitance $C_C$ of CMUT 1300 (i.e., greater than one order of magnitude so that $C_D >> C_C$), and thus, capacitance $C_D$ is also much larger than the capacitance $C_F$ of feedback capacitor 1340. Consequently, during a transmission operation by CMUT 1300, the voltage drop on the decoupling capacitor 1390 is negligible and almost all of the transmission input voltage $V_{TX}$ is applied on CMUT 1300 and feedback capacitor 1340. Moreover, in a variation of FIG. 13, feedback capacitor 1340 and the first bias circuit 1350 may be placed at the other side of TX/RX switch 860, similar to the implementation illustrated in FIG. 10, so that the feedback capacitor 1340 and the first bias circuit 1350 only function in TX and RX operations, respectively.

Figure 14:
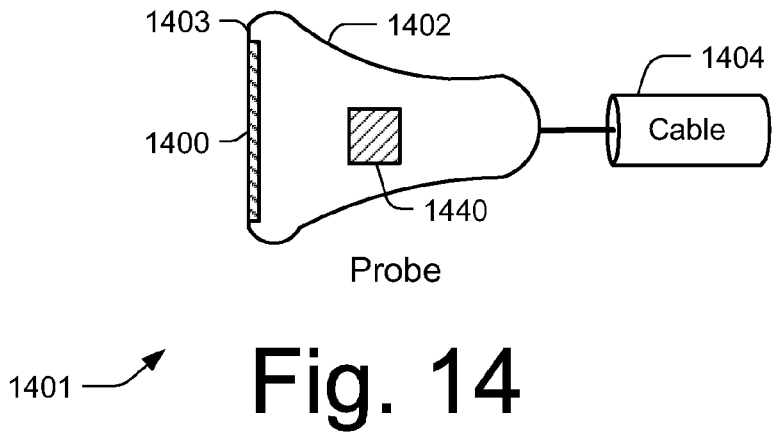
FIG. 14 illustrates an exemplary implementation of a system comprising a probe that includes a CMUT with a feedback capacitor.

The CMUTs with feedback capacitors discussed above with reference to FIGS. 1-13 may be incorporated into a variety of different systems, devices and the like. For example, FIG. 14 illustrates an exemplary probe 1402 used in an ultrasonic system 1401 according to some implementations. The probe is connected with the rest of the ultrasound system through a cable 1404, or the like. The implementation of FIG. 14 includes a CMUT 1400 having a feedback capacitor 1440 connected in series in accordance with the implementations disclosed above. In the implementation of FIG. 14, both the CMUT 1400 and the feedback capacitor 1440 are located in the probe 1402 of the ultrasound system.

Typically, the CMUT needs to be placed somewhere close to the probe surface to efficiently emit and receive ultrasonic energy. However, it is undesirable to have high voltage present somewhere close to the probe surface for safety considerations. Thus, in the implementation of FIG. 14, the CMUT 1400 is located at the probe front surface 1403. However, the feedback capacitor 1440 can be placed anywhere in the probe which is safe to hold relatively high voltage. Usually, it is preferred to place the feedback capacitor 1440 far from the surface of the probe. In view of these considerations, the CMUT 1400 and the feedback capacitor 1440 can be placed in the separated locations, so the CMUT 1400 is placed on the front surface 1403 of the probe 1402 and the feedback capacitor 1440 can be placed in a location in the probe 1402 which is safe for high voltage, such as within the interior of the probe 1402, isolated from the surface. In this case, as discussed above, the voltage ($V_A$) exposed near the probe surface in the implementations disclosed herein is much lower than the total transmission voltage ($V_{TX}$) when a CMUT is used in normal operation.

Figure 15:
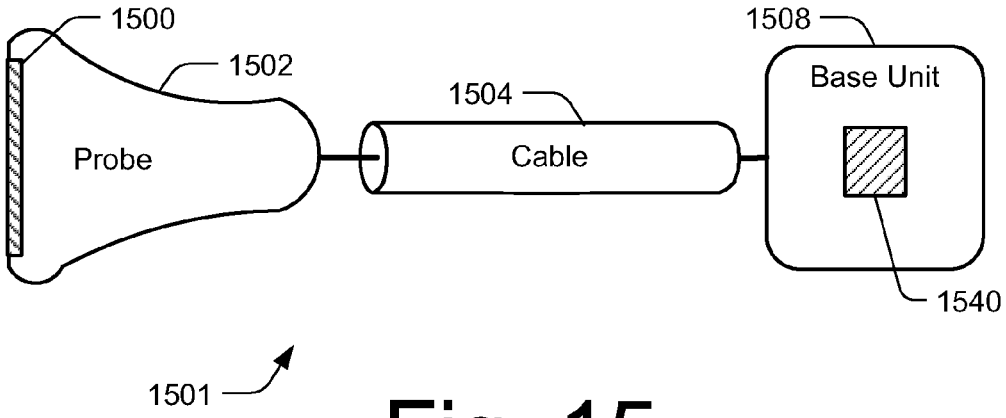
FIG. 15 illustrates another exemplary implementation of a system comprising a probe that includes a CMUT with a feedback capacitor.

Furthermore, in other implementations of an ultrasound system 1501, as illustrated in the exemplary implementation of FIG. 15, a feedback capacitor 1540 may be located remotely from a CMUT 1500 and arranged anywhere in the ultrasound system which is safe for high voltage. In the implementation of FIG. 15, CMUT 1500 according to implementations disclosed herein is located in an ultrasound probe 1502. Feedback capacitor 1540 is located at a separate location in a base unit 1508, or the like, and is connected in series with the CMUT 1500 via a cable 1504, or the like. This configuration may be useful, for example, for incorporation into a catheter, other probe type device or similar instruments. Any of the implementations described with reference to FIGS. 1-13 may be implemented in the systems of FIGS. 14 and 15.

From the foregoing, it will be apparent that implementations disclosed herein provide for CMUTs that can function on a lower voltage than that required by CMUTs in a normal operation for achieving the same displacement. This is useful when a large voltage may not be available or is not desirable in an implementation of an ultrasound system. For example, there are limitations regarding how high a voltage can be used for a device attached to or inserted into a human body. Further, implementations of the CMUTs disclosed herein are able to have a much smaller separation space or gap between two electrodes. The smaller electrode gap and lower required voltage also can increase the efficiency of the CMUTs during both transmission and receiving modes.

Implementations also relate to methods, systems and apparatuses for making and using the CMUTs described herein. Further, it should be noted that the system configurations illustrated in FIGS. 14 and 15 are purely exemplary of systems in which the implementations may be provided, and the implementations are not limited to a particular hardware configuration. In the description, numerous details are set forth for purposes of explanation in order to provide a thorough understanding of the disclosure. However, it will be apparent to one skilled in the art that not all of these specific details are required.

Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims. Additionally, those of ordinary skill in the art appreciate that any arrangement that is calculated to achieve the same purpose may be substituted for the specific implementations disclosed. This disclosure is intended to cover any and all adaptations or variations of the disclosed implementations, and it is to be understood that the terms used in the following claims should not be construed to limit this patent to the specific implementations disclosed in the specification. Rather, the scope of this patent is to be determined entirely by the following claims, along with the full range of equivalents to which such claims are entitled.

The invention claimed is:

1. A system comprising:

a capacitive micromachined ultrasonic transducer (CMUT) comprising:

a first electrode;

a second electrode separated from the first electrode by a gap so that a first capacitance exists between the first electrode and the second electrode;

a spring element supporting the second electrode for enabling the second electrode to move toward and away from the first electrode; and a feedback component connected in series with the CMUT, the feedback component providing a feedback on a voltage applied to the CMUT.

2. The system according to claim 1, wherein the feedback component is a capacitor providing a negative feedback on the voltage applied to the CMUT for decreasing the voltage as the first capacitance of the CMUT increases as a result of movement of the second electrode.

3. The system according to claim 1, wherein the feedback component is a capacitor having a second capacitance that is approximately equal to or less than the first capacitance.

4. The system according to claim 1, wherein the feedback component is a capacitor having a second capacitance that is between 10 percent and 300 percent of the first capacitance.

5. The system according to claim 1, wherein the feedback component is a capacitor having a second capacitance that is between 30 percent and 100 percent of the first capacitance.

6. The system according to claim 1, further comprising:

a switch actuatable to provide a path to avoid the feedback component when the CMUT is used in a receive mode for detecting acoustic energy, and actuatable to place the feedback component in series with the CMUT when the CMUT is used in a transmit mode to transmit acoustic energy.

7. The system according to claim 1, further comprising:

a bias circuit for applying a bias voltage between the feedback component and the CMUT.

8. The system according to claim 1, further comprising:

a switch between the feedback component and the CMUT, the switch connecting the CMUT in series with the feedback component and a source of transmission voltage when the CMUT is used in a transmit mode to transmit acoustic energy, the switch connecting the CMUT to a reception terminal when the CMUT is used in a receive mode for detecting acoustic energy; and a bias circuit for applying a biasing voltage between the switch and the CMUT.

9. The system according to claim 1, further comprising:

a switch between the feedback component and the CMUT, the switch connecting the CMUT in series with the feedback component and a source of transmission voltage when the CMUT is used in a transmit mode to transmit acoustic energy, the switch connecting the CMUT to a reception terminal when the CMUT is used in a receive mode for detecting acoustic energy; and a bias circuit for applying a biasing voltage when the switch connects the CMUT to the reception terminal.

10. The system according to claim 1, further comprising:

an ultrasonic probe having the CMUT located at a surface of the probe, and wherein the feedback component is located in the probe and isolated from the surface of the probe.

11. The system according to claim 1, further comprising:

an ultrasonic system having a probe including the CMUT located at a surface of the probe, and wherein the feedback component is located in a base unit of the ultrasonic system connected to the probe via a cable.

12. The system according to claim 1, wherein the feedback component is a resistor or an inductor having an impedance that is the same order of magnitude as an impedance of the CMUT at a predetermined operating frequency.

13. The system according to claim 1, wherein the feedback component is a resistor or an inductor having an impedance that is between 50 and 300 percent of an impedance of the CMUT at a predetermined operating frequency.

14. A method comprising:

providing a capacitive micromachined ultrasonic transducer (CMUT) including a first electrode and a second electrode separated from the first electrode by a space so that a first capacitance exists between the first electrode and the second electrode, the electrode being supported by a spring element for enabling the second electrode to move toward the first electrode and return toward an original position, wherein there is a first capacitance between the first electrode and the second electrode; and placing a feedback capacitor in series with the CMUT, the feedback capacitor having a second capacitance based on the first capacitance between the first electrode and the second electrode of the CMUT.

15. The method according to claim 14, further comprising:

applying a transmission voltage to the CMUT and the feedback capacitor to actuate the CMUT, wherein the feedback capacitor applies a feedback on the transmission voltage applied on the CMUT so that the transmission voltage applied on the CMUT decreases as the first capacitance of the CMUT increases during actuation of the CMUT.

16. The method according to claim 14, further comprising:

selecting the feedback capacitor to have the second capacitance to be less than or equal to the first capacitance of the CMUT.

17. The method according to claim 14, further comprising:

selecting the feedback capacitor to have the second capacitance to be between 30 and 100 percent of the first capacitance of the CMUT.

18. The method according to claim 14, further comprising:

selecting the feedback capacitor to have the second capacitance to be between 10 and 300 percent of the first capacitance of the CMUT.

19. A system comprising:

a capacitive micromachined ultrasonic transducer (CMUT) comprising:

a first electrode;

a second electrode separated from the first electrode by a gap so that a first capacitance exists between the first electrode and the second electrode when the second electrode is in a first position; and a flexible element supporting the second electrode for enabling the second electrode to move from the first position toward the first electrode for a predetermined displacement when a voltage is applied and return to the first position for producing acoustic energy; and a feedback capacitor connected in series with the CMUT, the feedback capacitor having a second capacitance between 10 and 300 percent of the first capacitance, wherein the feedback capacitor and the CMUT form a voltage divider so that an increase of the first capacitance of the CMUT decreases the voltage applied on the CMUT as the feedback capacitor provides a negative feedback on the voltage applied on the CMUT.

20. The system according to claim 19, wherein the system is an ultrasonic system having a probe including the CMUT located at a surface of the probe, and wherein the feedback capacitor is located in the probe and isolated from the surface of the probe, or located in a base unit of the ultrasonic system connected to the probe via a cable.

* * * * *